United States Patent [19]

Ludvik

[11] 4,381,581

[45] May 3, 1983

[54] HINGE MECHANISM

[75] Inventor: Josef A. Ludvik, Lyndhurst, Ohio

[73] Assignee: Reliance Electric Company, Cleveland, Ohio

[21] Appl. No.: 129,687

[22] Filed: Mar. 12, 1980

[51] Int. Cl.[3] ..... E05D 7/10; E05D 15/00; B65D 43/16; B65D 43/24

[52] U.S. Cl. ..... 16/259; 16/363; 16/364; 220/331; 220/333

[58] Field of Search ..... 16/179, 144, 173, 175, 16/192, 259, 363, 364; 220/331, 332, 333, 291, 336

[56] References Cited

U.S. PATENT DOCUMENTS

| | | | |
|---|---|---|---|
| 417,281 | 12/1889 | Record | 16/259 X |
| 1,154,920 | 9/1915 | Greenfield | 16/175 |
| 1,377,526 | 5/1921 | Rust | 16/179 X |
| 1,462,578 | 7/1923 | Kashinsky | 220/331 X |
| 2,147,246 | 2/1939 | Dahl | 220/333 X |
| 2,770,387 | 11/1956 | Loween | 220/333 X |
| 2,951,611 | 9/1960 | Tillson et al. | 220/333 |
| 3,052,372 | 9/1962 | Shepherd | 220/331 |
| 4,062,578 | 12/1977 | Chen | 16/144 X |

FOREIGN PATENT DOCUMENTS

| | | | |
|---|---|---|---|
| 362643 | 12/1931 | United Kingdom | 220/331 |

*Primary Examiner*—Wm. Carter Reynolds
*Attorney, Agent, or Firm*—Pearne, Gordon, Sessions, McCoy, Granger & Tilberry

[57] ABSTRACT

A three-part hinge mechanism is disclosed as a concealed hinge with two of the parts being first and second mounting brackets interconnected by a link. The first mounting bracket has means for mounting on an enclosure and the second mounting bracket has means for mounting on a cover for the enclosure. The hinge is concealed and permits the cover to be lifted or translated directly away from the enclosure by a sliding connection within the hinge and then the sliding connection becomes also a pivotal connection so that the cover may be pivoted to one side. This permits a relatively deep cover to enclose components mounted within the enclosure and closely adjacent the walls of the cover. By the first translational movement, the cover will clear these components and then the cover may be pivoted to one side. Additionally, the hinge may be readily connected and disconnected so that the cover may be completely moved out of the way for access to the components within the enclosure. The foregoing abstract is merely a resume of one general application, is not a complete discussion of all principles of operation or applications, and is not to be construed as a limitation on the scope of the claimed subject matter.

15 Claims, 8 Drawing Figures

HINGE MECHANISM

BACKGROUND OF THE INVENTION

Multipiece hinges have previously been proposed which provide limited sliding and pivotal movement so that a cover for an enclosure can be moved away slightly from the enclosure and then pivoted to one side. A number of such constructions have the hinge mechanism exposed on the outside of the enclosure, which is unsightly and also is subject to abuse, dirt, and malfunctioning. Others have had the hinge mechanism as a concealed hinge, but one which takes up considerable space within the enclosure so as to preclude use of that particular volume within the enclosure for any other purpose. In all such cases, however, the cover was relatively close to the enclosure so as to limit access to the enclosure even when the sliding connection was fully extended.

Another pivotal and sliding hinge embodied three parts of two mounting brackets and interconnecting links; however, once the hinge mechanism was assembled, it could not be readily disassembled so that the cover could not be completely removed from the enclosure should such be desired.

SUMMARY OF THE INVENTION

Accordingly, the problem to be solved is how to construct a hinge mechanism wherein a cover may have a sliding and pivotal connection via the hinge mechanism relative to an enclosure, yet retain a concealed hinge mechanism and one wherein the hinge mechanism may be readily disconnected so that the cover may be completely removed from the enclosure. Such problem is solved by a hinge mechanism for a cover of an enclosure comprising, in combination, a first mounting bracket, a second mounting bracket, and a link having first and second interconnection means to said first and second brackets, respectively, one of said mounting brackets having means for fixedly mounting same to an enclosure, and the other of said mounting brackets having means for fixedly mounting same to a cover which is adapted to cover the enclosure, said first interconnection means including a first pivot part on said first mounting bracket established along a first pivot axis, said first interconnection means including a second pivot part on said link pivotally interconnecting with said first pivot part for pivotal movement of said link on said first pivot axis of said first mounting bracket, said first pivot axis being substantially perpendicular to the length of said link, said second interconnection means including a U-shaped member with first and second generally parallel legs and a bight portion, said second interconnection means including a limit member coacting with one of the ends of said legs of said U-shaped member, said second interconnection means establishing a sliding connection and at least a limited pivotal connection about a second pivot axis between said link and said second mounting bracket, said second pivot axis being substantially perpendicular to the length dimension of said link, said sliding connection being substantially parallel to the length dimension of said link, one of said U-shaped and limit members being connected as part of said link and the other of said members being connected as part of said second mounting bracket, said limit member adapted to approach said bight portion as one limit of relative sliding movement between said link and said second mounting bracket, said second pivot axis being at said second mounting bracket and slidable along the length of said U-shaped member, said U-shaped member being a spring member to establish ready connection and disconnection between said mounting brackets at one of said pivot axes, said U-shaped member being constructed with relative elasticity between said legs and having feet positioned at said one of said pivot axes, said feet being movable in the plane of said U-shape to establish said ready connection and disconnection between said mounting brackets at said one of said pivot axes.

Accordingly, an object of the invention is to provide a concealed hinge mechanism which has two pivotal interconnections and a sliding connection.

Another object of the invention is to provide a concealed hinge mechanism which may be readily disconnected so that the cover may be completely disconnected from the enclosure.

Another object of the invention is to provide a hinge mechanism which is concealed yet which encroaches to a minimum extent on the volume within the enclosure.

Another object of the invention is to provide a hinge mechanism with two pivotal connections and a sliding connection yet all achieved within only three parts of the hinge mechanism.

Other objects and a fuller understanding of the invention may be had by referring to the following description and claims, taken in conjunction with the accompanying drawing.

DESCRIPTION OF THE PREFERRED EMBODIMENTS

Figure 1:
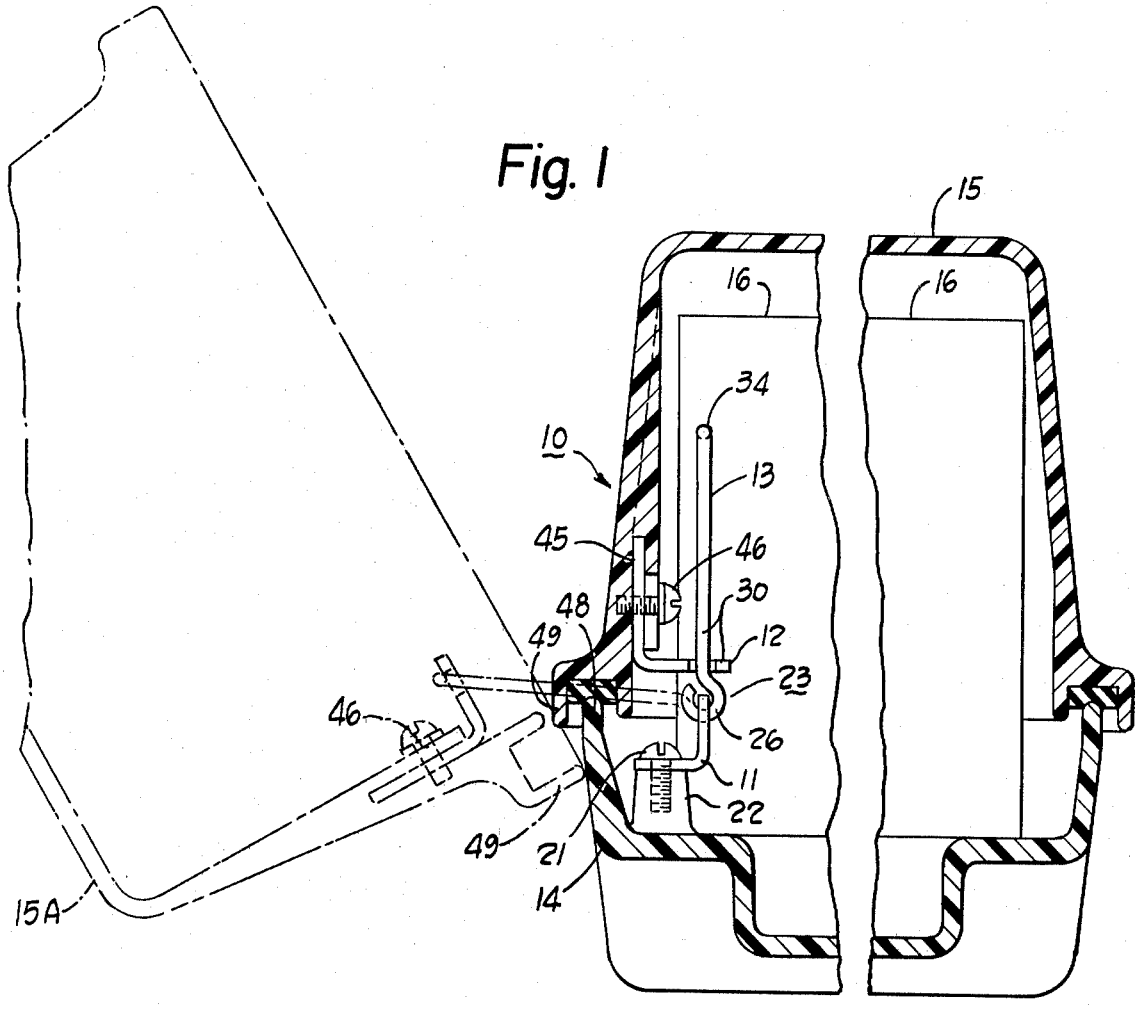
FIG. 1 is an end elevational view, partly in section, of a preferred form of hinge interconnecting an enclosure and a cover.

FIGS. 1 to 5 illustrate a hinge mechanism 10 which includes generally a first mounting bracket 11, a second mounting bracket 12, and an interconnecting link 13. The hinge mechanism 10 is one which is capable of many different uses but is illustrated as being used on an enclosure 14 with a cover 15 adapted to close that enclosure 14. The enclosure 14 is a relatively shallow base member, and the cover is a relatively deep cover covering components, e.g., electrical components 16, which may be tightly spaced within and nearly filling this deep cover 15. If an ordinary single pivot hinge were provided between the cover and enclosure, then it would be evident from FIG. 1 that the cover could not pivot to an open or closed position without striking the components 16. The present hinge mechanism obviates this difficulty.

Figure 2:
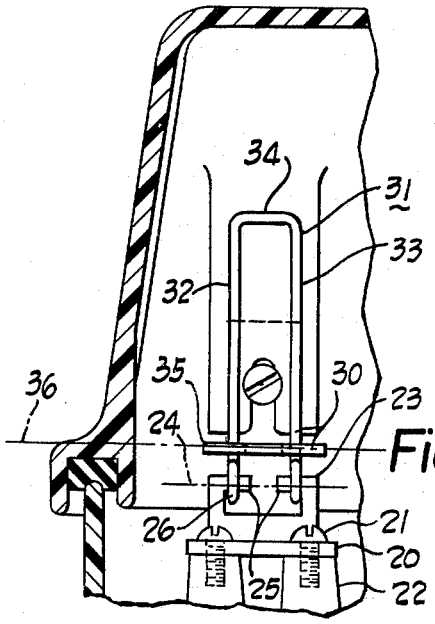
FIG. 2 is a front elevational view of the hinge mechanism.

The first mounting bracket 11 may be formed from stamped sheet metal and is generally L-shaped with a mounting foot 20 which may be secured by screws 21 into bosses 22 in the base or enclosure 14. A first interconnection means 23 is provided between the first mounting bracket 11 and the link 13. In this preferred embodient, this first interconnection means is a pivotal connection about a first pivot axis 24. The upstanding portion of the first mounting bracket 11 is provided with first pivot parts 25 which are inturned feet or male pivot parts established along the first pivot axis 24. The first interconnection means 23 also includes second pivot parts 26 on the link 13 to pivotally interconnect with the first pivot parts 25 for pivotal movement of the link on the first pivot axis 24 of this first mounting bracket 11. To coact with the male first pivot parts 25, the second pivot parts are female and are loops in the ends of the wire from which the link 13 is formed. As shown in FIG. 2, the first pivot axis 24 is substantially perpendicular to the length dimension of the link 13.

Figure 5:
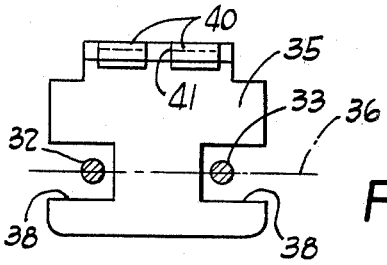

Second interconnection means 30 is provided between the second mounting bracket 12 and the link 13. The second mounting bracket 12 is secured to the cover 15, as described below, and the second interconnection means 30 in this embodiment provides a sliding connection and a limited pivotal interconnection between the second mounting bracket 12 and the link 13. One of the second bracket 12 and the link 13 at the second interconnection means 30 includes a U-shaped spring-wire member 31 with first and second generally parallel legs 32 and 33 and a bight portion 34. One of the second bracket 12 and the line 13 at the second interconnection means 30 further includes a limit member 35 coacting with one of the ends of the legs 32 and 33. The limited pivotal connection between the second mounting bracket 12 and the link 13 is about a second pivot axis 36 (see FIGS. 2 and 5). In this embodiment, this second pivot axis is established by the limit member 35, which is a part of the second mounting bracket 12. This limit member 35 is formed from a stamped sheet metal member with two opposing apertures or notches 38 in which the wire legs 32 and 33 may slide, as best shown in FIG. 5. The extra width of these notches 38 provides a lost motion interconnection which establishes the limited pivotal motion of perhaps 60 to 80 degrees in this embodiment. This second pivot axis 36 is substantially perpendicular to the length dimension of the link 13. The invention contemplates that one of the U-shaped member 31 and limit member 35 is connected as at least a part of the link 13 and the other of these members is connected as at least a part of the second mounting bracket 12. As is evident, the U-shaped member 31 in this embodiment is the link 13. The limit member 35 is adapted to approach the bight portion 34 as one limit of relative sliding movement between the link and the second mounting bracket 12, and additionally the U-shaped member 31 is a spring member to establish ready connection and disconnection between the mounting brackets at one of the pivot axes 24 and 36.

Figure 3:
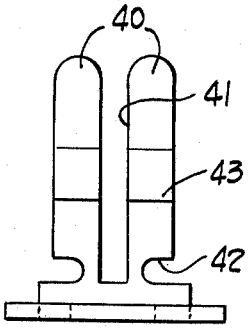
FIGS. 3, 4, and 5 are enlarged, front elevational, side elevational, and plan views of a cover mounting bracket for the hinge mechanism.
Figure 4:
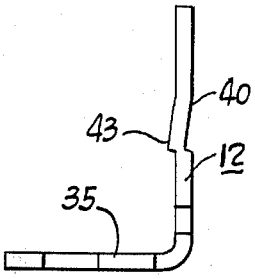

The second mounting bracket 12 is shown enlarged in FIGS. 3, 4, and 5, and is generally stamped from sheet metal into an L-shape with a mounting foot 40 and the limit member 35 as the two parts of the L-shape. The mounting foot 40 is a fork with a slot 41 therebetween. Apertures 42 weaken the forked mounting foot and barbs 43 are formed on the foot 40, which are shown as metal displaced from the plane of the mounting foot 40. The second mounting bracket 12 may easily be fixed to the cover 15 simply by being pushed into a pocket 45 molded or otherwise formed into the cover 15. This pocket may closely receive the mounting foot 40 to spring the forks of the mounting foot inwardly and the barbs 43 will dig into the surface of the pocket to prevent pullout of this mounting bracket from the cover 15. An optional screw 46 may be used to secure the mounting foot 40 in the cover 15 and such screw will pass through the slot 41.

OPERATION

The cover 15 may be secured to the base or enclosure 14 by some means, not shown. Upon removal or loosening of such securing means, then the cover 15 is ready to be removed. First, the cover may be moved in translation, moving it directly away from the enclosure 14. It may so move because of the sliding connection between the second mounting bracket 12 and the link 13 until the limit member 35 abuts the bight portion 34. At this point, the cover 15 will be elevated sufficiently to clear the components 16 mounted within the enclosure 14, even though such components extend the full height of the deep cover 15. Next, the cover 15 may be pivoted slightly at the second pivotal axis 36 and also may be pivoted at the first pivot axis 24. FIG. 1 shows in dot-dash lines the cover 15A as swung to the left about the first pivot axis 24 so that the link 13 has pivoted approximately 90 degrees to rest on the lip 48 of the enclosure 14. Also, the second mounting bracket 12 has pivoted about the second pivot axis 36 another 30 degrees approximately so that the cover 15 is disposed at about a 120-degree angle relative to the enclosure 14. This exposes the components 16 on all sides for ready access to such components. The hinge mechanism 10 protects the lip 48 of the enclosure 14 and also protects the gasket-enclosing lip 49 of the cover 15. Both the cover 15 and enclosure 14 may be made from molded plastic, so that the cover 15 may be quite light and will hang in the position shown in dot-dash lines in FIG. 1 regardless of whether the enclosure 14 is mounted vertically or horizontally.

The hinge mechanism 10 provides still greater convenience by permitting ready connection and disconnection of the cover 15 from the enclosure 14. As best illustrated in FIG. 2, it will be observed that the distal ends or feet of the legs 32 and 33 may be pressed together against the inherent spring bias of these legs, whereupon the pivotal interconnection at the first interconnection means 23 will be disconnected. As viewed in FIG. 1, with the cover open, a workman readily may reach in to press together these legs 32 and 33 in the plane of the U-shape. If there are two hinges aligned along one side of the enclosure 14, then both such hinge mechanisms may be readily disconnected so that the cover 15 may be completely removed from the enclosure 14. In such case, the links 13 will be retained on the second mounting bracket 12 because the bight portion 34 engages the second mounting bracket, or else the wire loops which are the second pivot parts 26 will engage the other side of this second mounting bracket, so that these links 13 will not become lost. Reconnection of the cover to the enclosure is made in a reverse manner, namely, the cover is brought into position and the legs of the U-shaped member 31 are squeezed together and then allowed to spring outwardly to engage the male pivot parts 25. This re-establishes the first interconnection means 23. Since the legs 32 and 33 are substantially straight and parallel, they are substantially inelastic along the length of the legs to positively retain the cover when open.

Figure 6:
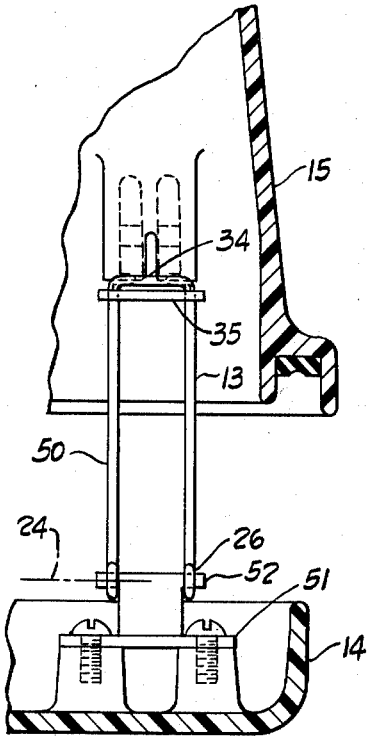
FIG. 6 is a view similar to FIG. 2 of a modification, but with the cover elevated.

FIG. 6 illustrates, in a single view, a modified form of hinge mechanism 50 with a first mounting bracket 51. Such mounting bracket still establishes the first pivot axis 24, but this mounting bracket has out-turned first, or male, pivot parts 52 to engage the female, or second, pivot parts 26 on the link 13. FIG. 6 illustrates the cover 15 raised or translated away from the enclosure 14 so that the limit member 35 is in engagement with the bight portion 34 of the U-shaped link 13. This is a first part of the movement of the cover 15, as described above, for the embodiment of FIGS. 1–5.

To completely remove the cover from the enclosure 14, the distal ends or feet of the legs of the U-shaped link 13 would be spread apart in the plane of the U-shape to free them from the male pivot parts 52, and then the cover would be separated from the enclosure. For reconnection of the cover, the legs would need to be spread apart and then allowed to spring back toward each other to reconnect the second pivot parts 26 on the first pivot parts 52.

Figure 8:
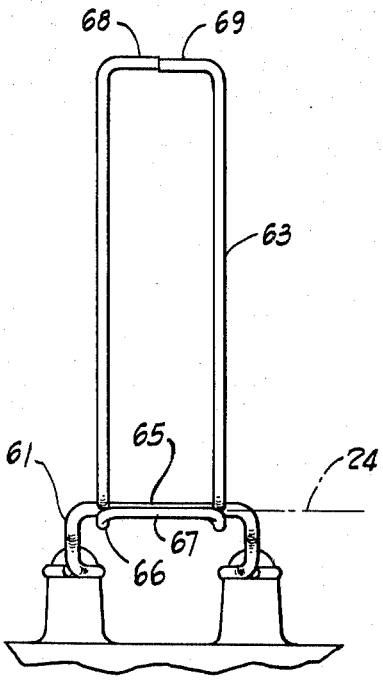
FIG. 8 is a front elevational view of the enclosure mounting bracket and link used in FIG. 7.
Figure 7:
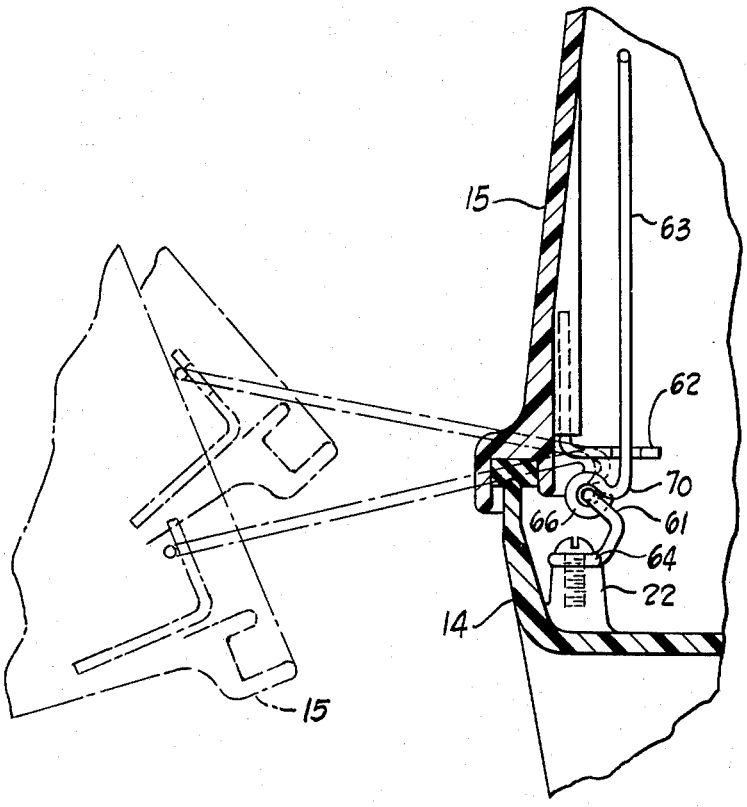
FIG. 7 is a view similar to FIG. 1 of another modification.

FIGS. 7 and 8 illustrate a further embodiment of the invention in a hinge mechanism 60 which has first and second mounting brackets 61 and 62, respectively. These mounting brackets are interconnected by a link 63. The second mounting bracket 62 may be essentially the same as the second mounting bracket 12 of FIGS. 1–5. The first mounting bracket 61 is shown as being made from formed wire, with mounting feet 64 which may be secured to the bosses 22. This first mounting bracket 61 has a first, or male, pivot part 65 on which the U-shaped link 63 is pivoted. This pivoting is about the first pivot axis 24. In this embodiment, the U-shaped spring-wire link 63 has a bight portion 67 closely adjacent the female second pivot parts or loops 66 which pivot on the first pivot parts 65. The distal ends of the U-shaped member have in-turned separate feet 68 and 69 which can engage the cover mounting bracket 62 as one limit of sliding movement.

The link 63 not only has the elongated portion to establish sliding connection relative to the second mounting bracket 62, but also has an L-shaped bend 70 so that the pivot axis 24 is displaced from the plane of the main part of the link 63. Such offset may be used to change the attitude of the cover relative to the enclosure in the open position of the cover, or may be used to change the mounting position of the first mounting bracket 61 within the enclosure 14.

In order to separate the cover from the enclosure, the spring-wire legs of the link 63 may be separated, and then the distal ends 68 and 69 may be removed from the cover mounting bracket 62. In this case, the link 63 remains connected to the enclosure, rather than to the cover, as in the embodiments of FIGS. 1–6.

The hinge mechanisms 10, 50, or 60 of the present invention may be economically manufactured and assembled to the cover and enclosure. Simple stampings of sheet metal and simply formed wire members are the parts of the hinge. No re-entrant surfaces are required on either the enclosure 14 or cover 15. To accomplish this, the mounting brackets 11, 12, 51, 61, and 62 are so constructed that the enclosure and cover may be economically molded of plastic, for example, in simple molds of only two parts, with a parting line parallel to the plane of the lip 48 or 49, respectively. The bosses 22 are upstanding from the floor of the enclosure 14, and the unitary pocket 45 in the cover for the second mounting bracket 12 or 62 is perpendicular to the lip 49. Such simply constructed shapes are permitted by the structure of the hinge mechanisms 10, 50, or 60.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A hinge mechanism for a cover of an enclosure comprising, in combination, a first mounting bracket;

a second mounting bracket; and a link;

first interconnection means comprising portions of said link and said first bracket;

second interconnection means comprising portions of said link and said second bracket;

one of said mounting brackets having means for fixedly mounting same to an enclosure, and the other of said mounting brackets having means for fixedly mounting same to a cover which is adapted to cover the enclosure;

said first interconnection means including a first pivot part on said first mounting bracket established along a first pivot axis, said first interconnection means including a second pivot part on said link pivotally interconnecting with said first pivot part for pivotal movement of said link on said first pivot axis of said first mounting bracket, said first pivot axis being substantially perpendicular to the length of said link;

one of said second bracket and said link at said second interconnection means including a U-shaped member with first and second generally parallel legs and a bight portion, one of said second bracket and said link at said second interconnection means including a limit member coacting with one of the ends of said legs of said U-shaped member, said second interconnection means establishing a sliding connection and at least a limited pivotal connection about a second pivot axis between said link and said second mounting bracket, said second pivot axis being substantially perpendicular to the length dimension of said link, said sliding connection being substantially parallel to the length dimension of said link, one of said U-shaped and limit members being connected as at least part of said link and the other of said members being connected as at least part of said second mounting bracket, said limit member adapted to approach said bight portion as one limit of relative sliding movement between said link and said second mounting bracket, said second pivot axis being at said second mounting bracket and slidable along the length of said U-shaped member, said U-shaped member being a spring member to establish ready connection and disconnection between said mounting brackets at one of said pivot axes, said U-shaped member being constructed with relative elasticity between said legs and having feet, serving as a part of said first interconnection means, positioned at said one of said pivot axes, said feet being movable in the plane of said U-shape to establish said ready connection and disconnection between said mounting brackets at said one of said pivot axes.

2. A hinge mechanism as set forth in claim 1, wherein said link includes said U-shaped member.

3. A hinge mechanism as set forth in claim 1, wherein said first mounting bracket has inwardly facing members as said first pivot part and said U-shaped member has said feet as said second pivot part engaging said inwardly facing members.

4. A hinge mechanism as set forth in claim 3, wherein said legs of said U-shaped member may be elastically deflected toward each other to establish said disconnection and returned away from each other along said one of said pivot axes to establish said connection between said mounting brackets at said first and second pivot parts.

5. A hinge mechanism as set forth in claim 1, wherein said first mounting bracket has outwardly facing members as said first pivot part and said U-shaped member has said feet as said second pivot part engaging said outwardly facing members.

6. A hinge mechanism as set forth in claim 5, wherein said legs of said U-shaped member may be elastically deflected away from each other along said one of said pivot axes to establish said disconnection and returned toward each other to establish said connection between said mounting brackets at said first and second pivot parts.

7. A hinge mechanism as set forth in claim 1, wherein said legs of said U-shaped member are bent to establish an offset between said second pivot axis and the plane of the remaining portion of the U-shaped member.

8. A hinge mechanism as set forth in claim 1, wherein said limit member is a part of said second mounting bracket.

9. A hinge mechanism as set forth in claim 1, wherein said limit member is disposed between the legs of said U-shaped member.

10. A hinge mechanism as set forth in claim 9, wherein said limit member is adapted to abut said bight portion as one limit of said relative sliding movement.

11. A hinge mechanism as set forth in claim 1, wherein said sliding connection is established by said limit member and the legs of said U-shaped member.

12. A hinge mechanism as set forth in claim 1, wherein all parts of said mechanism are concealed within the enclosure and cover therefor.

13. A hinge mechanism as set forth in claim 1, wherein said means to fixedly mount said mounting brackets includes surface means in the enclosure and cover with non-reentrant surfaces to permit manufacture of each of the enclosure and cover in only two-part molds.

14. A hinge mechanism as set forth in claim 1 wherein said feet are in-turned feet on the distal ends of the legs thereof to engage said second mounting bracket as part of said second interconnection means.

15. A hinge mechanism as set forth in claim 1, wherein said U-shaped member is substantially inelastic along the length of said legs.

* * * * *